US005189250A

United States Patent [19]

Shaphyr

[11] Patent Number: 5,189,250

[45] Date of Patent: Feb. 23, 1993

[54] PROJECTILE FOR SMOOTH BORE WEAPON

[75] Inventor: Shalom Shaphyr, London, England

[73] Assignee: Frag, Ltd., New Quay Douglas, Isle of Man

[21] Appl. No.: 735,378

[22] Filed: Jul. 24, 1991

Related U.S. Application Data

[63] Continuation-in-part of Ser. No. 416,959, Oct. 4, 1989, abandoned.

[30] Foreign Application Priority Data

Oct. 5, 1988 [GB] United Kingdom ..... 8823264

[51] Int. Cl.[5] ..... F42B 10/16; F42B 12/20; F42B 15/21

[52] U.S. Cl. ..... 102/439; 102/247; 102/259; 102/483; 102/500; 244/3.29

[58] Field of Search ..... 102/239, 242, 247, 258, 102/259, 376, 473, 483, 439, 499, 500, 520, 524, 527; 42/105; 244/3.27, 3.28, 3.29

[56] References Cited

U.S. PATENT DOCUMENTS

| | | | |
|---|---|---|---|
| H405 | 1/1988 | Covey | 89/1.816 |
| 1,861,522 | 6/1932 | Brandt . | |
| 2,755,738 | 7/1956 | Jones et al. | 102/78 |
| 2,996,012 | 8/1961 | Butler | 102/93 |
| 3,157,126 | 11/1964 | Blondeau | 102/92.5 |
| 3,177,809 | 4/1965 | Russell-French | 102/49 |
| 3,326,128 | 6/1967 | Choate | 102/38 |
| 3,576,165 | 4/1971 | Gawlick et al. | 102/73 |
| 3,612,857 | 10/1971 | Beatty | 102/342 |
| 3,638,571 | 2/1972 | Gawlick et al. | 102/41 |
| 3,650,213 | 3/1972 | Abbott et al. | 102/38 |
| 3,820,463 | 6/1974 | Leonard et al. | 102/38 |
| 3,964,696 | 6/1976 | Orzechowski et al. | 244/3.23 |
| 3,968,945 | 7/1976 | Walton | 244/3.28 |
| 4,434,718 | 3/1984 | Kopsch et al. | 102/522 |
| 4,611,540 | 9/1986 | Pettersson et al. | 102/372 |
| 4,697,524 | 10/1987 | Penner et al. | 102/498 |

FOREIGN PATENT DOCUMENTS

| | | | |
|---|---|---|---|
| 556230 | 4/1957 | Belgium | 102/258 |
| 3033061A1 | 4/1982 | Fed. Rep. of Germany . | |
| 3304393A1 | 10/1983 | Fed. Rep. of Germany . | |
| 873628 | 10/1939 | France . | |
| 2241762 | 3/1975 | France | 102/239 |
| 1409940 | 10/1975 | United Kingdom . | |
| 1527971 | 10/1978 | United Kingdom . | |
| 2150673A | 7/1985 | United Kingdom . | |

*Primary Examiner*—Harold J. Tudor
*Attorney, Agent, or Firm*—Woodcock Washburn Kurtz Mackiewicz & Norris

[57] ABSTRACT

The invention provides a projectile adapted to be fired from a smooth bore weapon, such as a shotgun, by means of a cartridge containing a propellant charge. The projectile comprises a generally cylindrical casing and a warhead assembly, the warhead being hollow to accommodate an explosive charge and an initiator, the casing being formed with a firing pin spring biased to a safety position and locked in the safety position by a spring biased safety pin. The spring biased safety pin is adapted to release the firing pin in a predetermined period of time after the projectile exits from the weapon. The casing includes a plurality of fins foldable within the cartridge, but which deploy radially on leaving the weapon.

14 Claims, 4 Drawing Sheets

PROJECTILE FOR SMOOTH BORE WEAPON

This application is a Continuation-In-Part application of application Ser. No. 416,959, filed Oct. 4, 1989 now abandoned.

FIELD OF THE INVENTION

The present invention relates to a projectile particularly suitable for a smooth bore weapon such as a shotgun, and preferably a 12 bore shotgun.

BACKGROUND OF THE INVENTION

Explosive projectiles are well known in the art but mainly for large weapons. The present invention pertains to projectiles which are provided in cartridge form and are particularly suitable for use in standard 12 bore shotguns. However, the projectiles according to the present invention are equally applicable to shotguns of greater or smaller bores.

Gawlick et al U.S. Pat. No. 3,576,165 and German DE-3033061 disclose a projectile having a safety device including a locking pin, one end of which is inserted into the projectile perpendicular to the projectile axis, which prevents premature detonation. The outer head of the pin is flush with the outer surface of the projectile, so that, in use, the pin can contact the barrel of the weapon from which it is fired. Since the pin is outwardly spring-biased, it is urged radially outwardly and hence ejects after leaving the barrel to arm the warhead. However, such projectiles contact an intermediate objects prior to reaching the target, the active charge may be prematurely initiated. If this occurs too soon after the operator has fired the projectile, the operator could himself be in danger. Although the Gawlick patent discloses that the safety pin is ejected a finite period of time after the projectile leaves the barrel, it does not disclose a method for ensuring that the safety pin is not ejected prematurely. This problem has been addressed in U.S. Pat. No. 4,697,524 (EPA-0-147932). The solution proposed therein is to provide a locking pin which is ejected by gas pressure alone. The inherent complexity of this solution leads to high costs and munitions failure in use.

The problem of premature detonation of the warhead is especially severe for non-self-propelled projectiles which have fins angled with respect to the axis of the projectile so as to impart spin. This is so because upon exiting the barrel, the wind resistance of the fins causes a rapid deceleration of the projectile which tends to drive the firing pin into the initiator if the safety pin is ejected too soon.

Leonard et al. U.S. Pat. No. 3,820,463 discloses a shotgun grenade comprising a warhead portion interfitted with a grenade casing provided at its rear end with a plurality of circumferential ribs for stability in flight. This device, although available since 1974, has not been in use for a number of reasons. In the first place, the safety pin is a shear pin adapted to fracture on impact. Such shear pins also fracture if the grenade is inadvertently dropped with serious consequences for the user. Shear pins can also remain intact if the grenade is fired into water, snow, soft mud, etc. leading to a failure of the round to detonate in use. Moreover, it is important in this approach that the nose portion be rifled to impart spin. However, since shotgun barrels are rarely rifled, the actual spin imparted is usually minimal and hence accuracy is impaired. Finally it should be noted that the actual grenade is only 3.6 cm long, hence the amount of collateral damage achievable by use of this device is relatively small.

Kopsch U.S. Pat. No. 4,434,718 and Abbott U.S. Pat. No. 3,650,213 each provide a finned projectile for firing from a 12 bore shotgun. In these devices the projectile is provided with fixed fins to impart spin. Unfortunately, the effect of the use of fixed fins is to reduce the size of the payload (throw-weight). Further, in neither of these documents is a separate arming device or safety device discussed.

Russell-French U.S. Pat. No. 3,177,809 discloses rocket assisted artillery rounds provided with a cartridge case extending only over a portion of the folded down fins so that, when the round is fired from the barrel of an artillery piece, the fins are urged by a spring to deploy to their radially outward positions, thereby stabilizing the rocket propelled round during its flight. However, the use of folded down fins has not been described with reference to ammunition without its own means of propulsion.

Jones U.S. Pat. No. 2,755,738 discloses safety fuses for rockets which provide locking elements which lock the firing mechanism of a missile until it leaves its barrel, whereupon the elements disengage under radial spring pressure to release a firing pin. A similar device is to be found in Gawlick et al. U.S. Pat. No. 3,638,571, wherein a recoil-less mortar practice round is described. Both the Gawlick and Jones patents relate to missiles with their own propellant system. Self-propelled missiles have a high mass and are driven by self-generated propellant gas to accelerate from the barrel with only marginal deceleration upon exiting from the muzzle.

SUMMARY OF THE INVENTION

It is an object of the present invention to improve upon prior art devices by providing, in a first aspect, an arrangement in which the throw weight of the projectile is relatively increased despite the constraints associated with chambering in a standard shotgun barrel.

It is a second object of the invention to provide a projectile in which spin is imparted after the projectile leaves a smooth bore barrel.

It is a third object of the invention that the projectile have a first safety feature which allows the warhead to be attached by a skilled person immediately prior to firing. Moreover, the arrangement is such that the projectile with or without the casing is quite safe if inadvertently dropped.

It is a fourth object to provide a delayed arming effect mediated by the increased drag induced immediately when the fired projectile leaves the barrel of the weapon.

These and other features of the invention will be apparent from the following description.

According to the first aspect of the invention, therefore, there is provided a shotgun projectile which comprises a generally cylindrical casing and warhead assembly, said warhead being hollow to accommodate an explosive charge and an initiator, the casing being formed with a firing pin spring biased to a safety position and locked in said safety position by means of a safety pin; characterized in that the projectile is at least in part retained prior to firing in a cartridge case including a propellant charge and in that the cartridge case also retains a plurality of fins in the folded down condition disposed upon casing of the projectile; each fin being spaced an equal distance about the periphery of the casing and being pivoted thereto, and in that the safety pin is spring biased whereby both the safety pin and the fins displace radially outwardly relative to the casing upon exiting from the barrel thereby to provide a projectile which is both stabilized and armed by the act of leaving the barrel.

Central to the invention is the provision of a projectile which is both stabilized and armed only after leaving the barrel of the weapon from which it is fired. The projectile is stabilized by use of the deployed fins; the firing of the projectile with the fins in a folded down condition allows for an increase in throw-weight of the device over shotgun projectiles previously provided. The arming of the device after it has left the barrel is a safety feature. Arming the projectile prior to firing results in the danger that the operator may be injured if the ammunition is inadvertently dropped prior to use.

In a preferred form of the invention, the casing and the warhead are separately formed and interlock only on assembly with the cartridge.

In another preferred form of the invention, the casing is provided with three or four fins thereupon, each fin being spaced an equal distance about the periphery of the casing. It is most preferred that one plane of the fin be angularly displaced from the axial plane of the projectile by a set amount — for example, 8° to 25° to the longitudinal axis of the projectile — so as to impart spin to the projectile, thereby increasing its stability. The fins may be arcuate so as to lie over the external periphery of the casing while they are within the cartridge or the barrel of the weapon. The fins may, of course, be formed of a resilient material, one end of which is located in the casing, the arrangement being such that the fins spring outwardly on release from the barrel after firing. In a preferred form of the invention, the fins, although generally directed in a plane passing through the axis of the projectile, are formed with a triangular transverse cross-section whereby a first plane of each fin lies in the plane of the axis of the projectile while the other is angled thereto in the range of up to 25°, preferably about 10°, and most preferably 12°, so as to impart spin.

I have found that the fins cannot be angled by much more than 28° to the axis of the missile because the thickness of the fins, if they are to be effective, has the effect of reducing the throw-weight. Whereas obviously this reduction of the throw-weight is not critical to the operation of the device, it is nevertheless desirable to make maximum utility of the space available. Further, unless hinges of great strength are provided, hinged fins tend to be ripped off the casing upon exiting from the barrel if the angle of attack of the inclined plane is too severe. Further, the use of fins which are angled in excess of about 30° tends to reduce the effective range of the device by increasing wind resistance.

At much less than about 8°, the spin imparted to the missile is not really sufficient for effective stability. Consequently, although smaller angled planes can be utilized successfully in some cases, an angle of at least 8°, preferably 12° or 15°, is generally preferred.

In an alternative form of the invention, a pivotal hinge is provided immediately adjacent the periphery of the casing and arcuate fins are provided accordingly. Air pressure passing over the projectile upon exiting from the barrel will cause the fins to extend, especially if the axis is angled to the exit of the projectile. This mechanism may also be assisted by resilient means if desired.

The casing is preferably formed with an axial bore to accommodate a generally cylindrical firing pin. The firing pin is preferably biased to its safe position by means of a compression spring between the operative end of the firing pin and the initiator. The compression spring acts to spring bias the firing pin to its "at rest"position. In the "at rest" position the firing pin is also secured by means of a safety pin which is located in a bore normal to the axis of the firing pin. The safety pin is spring biased away from the firing pin and is provided with an outwardly arcuate head external of the casing which, in use, is in sliding contact with the internal face of the cartridge from which the projectile is to be fired, and with the internal surface of the bore of the weapon. It will be appreciated, therefore, that the safety pin is released after exit from the barrel, whereupon the firing pin is retained in its "at rest" condition by means of the spring biasing separately provided.

In an alternative arrangement, two coaxial safety pins are provided which are spring biased in opposed directions, thereby to balance the projectile in the early part of its flight.

The warhead may be formed of a hollow casing, preferably provided with a number of fragmentation recesses about its internal or external periphery. In another embodiment, the hollow casing is plain but has interfitted therein a fragmented helical spring over which the explosive is cast in manufacture. The warhead is also provided towards its forward portion with a sealant recess. This sealant recess accommodates a soft plastic sealant ring which, in use, contacts the bore of the smooth bore weapon. The sealant ring, which is soft, ensures a proper seal between the projectile and the bore, even if the bore is in some way deformed. Internally, the warhead is provided with a standard explosive, such as RDX, provided towards its rear end with an initiator which is either held on a support plate immediately adjacent the rear of the charge, or interfits in a recess in the charge itself.

The casing may be formed of aluminum or steel depending upon weight requirements, or alternatively may be molded from an epoxy resin into which ball bearings of the necessary weight have been dispersed. The casing may be provided with a tracer compound initiated by the propellant charge if desired.

The projectile is particularly suitable for use in smooth bore weapons such as shotguns. In an alternative form of the invention, there is provided an arrangement for using the projectile in a rifled weapon wherein the fins are retained by, or located immediately adjacent, a soft plastic annulus which ensures that the external faces of the fins do not come into contact with the rifle in use.

The situation of a shotgun projectile is quite different from that which pertains to artillery ordinance. Although the shotgun projectile of the invention has as high a throw-weight as practicable, it is very light in comparison with a rocket propelled artillery shell or similar ordnance. Nor is the projectile of the current invention self-propelled. These differences result in a significant difference in the modus operandi of the projectile of the invention as it leaves the barrel.

The firing of the charge causes the projectile to accelerate up the barrel and to exit therefrom. Upon exiting, the fins are deployed under spring pressure. The increased drag associated with the deployment of the fins causes a rapid and substantial deceleration of the projectile. This deceleration urges the firing pin forward towards the initiator. In the absence of a safety mechanism there would be a grave danger that this deceleration would cause the firing pin to contact the initiator and cause an explosion immediately adjacent the user. Thus, for safety reasons, it is important that the projectile not be armed immediately on leaving the barrel.

The projectile of the invention is thus provided with a safety pin which cooperates in a bore generally perpendicular to the axis of the firing pin and which is spring biased radially outward. Consequently, the effect of deceleration on the projectile upon exiting the barrel is to cause the forward inertia of the firing pin to impose a shear force on the shaft of the safety pin. This shear force creates frictional resistance between the cylindrical safety pin shaft and the bores in the casing and firing pin within which the safety pin slides, thereby resisting ejection of the safety pin by the spring force. As a result, the firing pin and the safety pin are temporarily locked together, generally for about 0.01 to 0.3 seconds after leaving the barrel.

Thereafter, the deceleration effect diminishes so as to allow the safety pin to release and arm the projectile. By this time the projectile is no longer subject to acute deceleration forces and is usually at least 30 to 40 yards down range. Thus the projectile will not detonate until impact. This delayed arming effect is unique to the use of spring biased safety devices for shotguns as described.

The present invention in a second aspect, seeks to provide a projectile of the spring biased locking pin type but with a secondary arming time delay mechanism. This arrangement is simple to manufacture and safe to use. Thus, in accordance with the present invention, there is provided a projectile, suitable for use with a smooth bore weapon, comprising a generally cylindrical casing and a warhead assembly, the warhead being hollow to accommodate an explosive charge and an initiator, the casing being formed with a firing pin, spring biased to a safety position and locked in the safety position by means of a spring biased safety pin, the invention being characterized in that the safety device additionally comprises a secondary safety means adapted to retain the safety pin in a safety position for a predetermined period after the projectile has left the weapon and to arm the same prior to impact. The predetermined period is preferably a time under one second, and most preferably a time delay of from 0.01 to 0.3 seconds.

The secondary safety means may comprise a retaining means co-operating between a pair of coaxial safety pins spring biased in opposed directions, the retaining means being adapted to cause a friction-mediated time delay before the primary safety pins are expelled. In an alternative embodiment, a secondary safety means is formed by a crank in the safety pin co-operating in a suitable bore in the casing. The crank allows the release of the pin only on being swiveled forward on deceleration of the projectile as the projectile leaves the weapon in use.

In a particularly preferred form of the invention, when the projectile is fired by an explosive propellant charge, the secondary safety means may be a layer of combustible adhesive material interposed between the firing pin and the hollow portion of the casing, whereby combustion of the adhesive material is actuated on explosion of the propellant charge to give a time delay before the firing pin can be released from the casing. In a preferred form of the invention of this type, the layer of combustible adhesive material is connected by a bore to the rear end of the casing.

DESCRIPTION OF THE PREFERRED EMBODIMENT

Figure 1:
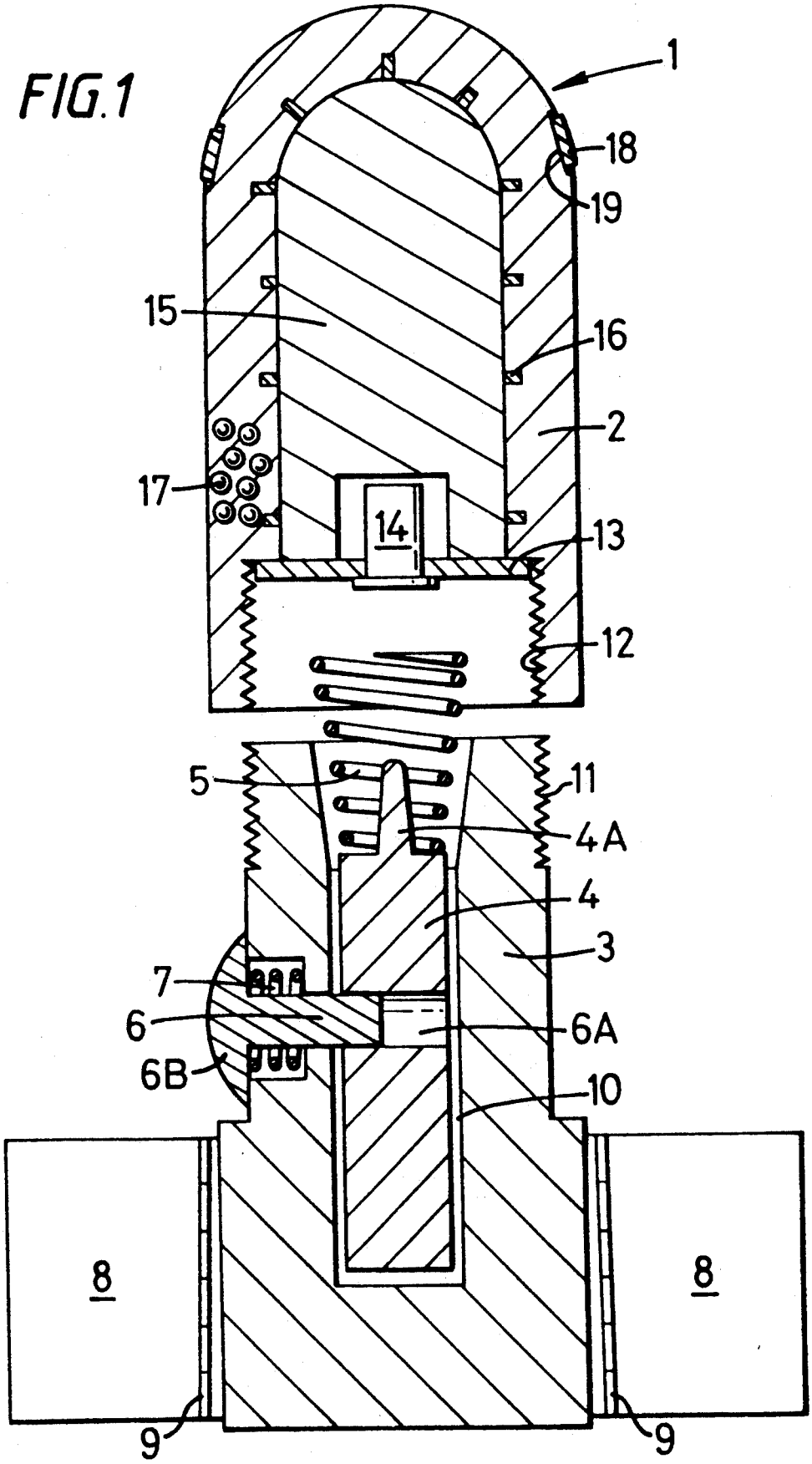
FIGS. 1 and 3 are vertical cross-sections through two embodiments of the projectile according to the current invention removed from a 3 inch (7.56 cm) 12 bore cartridge and separated into component parts.

The invention will now be described, by way of illustration only, with reference to the accompanying drawings. With reference to FIG. 1 a projectile (1) is formed with a warhead (2) and a casing (3). The projectile has a generally cylindrical configuration about a central axis, and is formed in this instance of aluminum castings. The warhead (2) and the casing (3) are separately formed castings provided with interlocking means (11, 12) whereby the two portions may be interlocked immediately prior to assembly with a 12 bore cartridge.

The casing (3) is provided with an axial bore (10) which accommodates a cylindrical firing pin (4) provided at its operative end with a conical needle portion (4A). The firing pin is also provided with a bore (6A), normal to the axis thereof, to accommodate a safety pin shaft (6).

The safety pin shaft (6) is, in the safe position, located in the bore (6A) and provided with a safety pin cap (6B) and a compression spring (7) located in a suitable recess in the casing (3). The safety pin shaft (6) is biased by means of the spring (7) away from the firing pin (4), the safety pin being held in the safe position by means of its contact, in use, with the internal wall of the cartridge case or the internal bore of the smooth bore weapon.

Located at the remote end of the casing and about the external periphery thereof are four fins (8) which, in use, extend radially outwardly from the body of the casing (3). The fins (8) are of an arcuate configuration such that they will, in their folded-down position within the cartridge case, lie over the body of the casing. To this end they are hinged at (9), the axis of the hinge being parallel with the longitudinal axis of the projectile. The fins have an angled profile such that air pressure will cause the fins to open and to spin the projectile when it has exited from the bore of the weapon. The fins may be formed of a resilient material such as a copper alloy, or may be molded into their final form from plastics or a moldable metal such as aluminum.

The warhead assembly (2) is formed from a hollow aluminum casting of a generally cylindrical configuration formed with a domed forward end. The domed forward end conjoins the cylindrical portion at about the point at which an annular recess (19) is provided therein. The annular recess is provided with a soft plastic material sealant (18) which is adapted in use to contact the internal bore of the weapon after firing.

The hollow portion of the warhead (2) is provided with an explosive (15) — for example RDX. The block of explosive (15) is, in this particular embodiment, provided with a central blind bore for the accommodation of an initiator (14) which, in this particular instance, is retained by means of a retaining plate (13) which locates the explosive (15) in the body of the warhead (2). In an alternative embodiment, the retaining plate (13) may be dispensed with, and the initiator (14) may be formed as a sliding fit into the recess in the explosive charge (15).

Pre-molded fragmentation portions (16) may also be formed on the internal or external faces of the warhead (2). In an alternative embodiment, the warhead (2) may be formed of hard epoxy resin into which a plurality of ball bearings (17) has been disposed. The advantage of this latter construction is that the weight of the warhead can be carefully adjusted by means of the utilization of the correct number and weight of ball bearings. Further, the point of balance of the projectile assembly can be altered by placing the ball bearings at various positions in varying numbers within the body of the material forming the warhead.

In use, the explosive charge which is molded into a predetermined shape is interfitted in the warhead (2) and the initiator (14) positioned therein. The casing (3) is assembled by sliding the firing pin (4) into the bore (10) of the casing (3) with the bore (6A) in register with the shaft of the safety pin (6). The cap (6B) of the safety pin is then retained in its "pressed in" condition in order to retain the safety pin in its "at rest" condition. The casing (3) and warhead (2) are then interfitted by sliding the two together ensuring that the compression spring (5) is free to move. The assembly of the casing (3) and the warhead (2) such that the interlocking means (11, 12) inter-relate, causes the firing pin (4) to be forced away from the initiator (14) by means of the spring (5). While retaining the safety pin cap (6B) in its "pressed in"condition, the fins (8) are then positioned in their radially inward positions and the device is slid into a standard 12 bore cartridge so as to fit on the top of the wadding immediately over the propellent charge. As the casing (3) slides into the standard 12 bore cartridge, the cap (6B) of the safety pin will come into sliding relationship therewith such that firing pin (4) is retained against any possibility of release so that even if the cartridge is dropped during use, the explosive charge will not fire.

The cartridge may then be positioned in a standard shotgun and fired in the normal way. On firing the projectile (1) leaves the cartridge and travels along the smooth bore barrel with the sealant (18) and the cap (6B) of the safety pin in contact therewith. Upon exiting from the barrel, the restraint is removed from the safety pin cap (6B) and this will tend to be thrown outwardly by means of the compression spring (7) after a predetermined period, thereby releasing the firing pin (4) for actuation. Of course, immediately upon exiting from the barrel, the projectile (1) will undergo fairly severe deceleration and hence there is a danger that the firing pin might contact the initiator (14). This is prevented by means of the spring (5) which loads the firing pin into its "at rest"position until impact. Further, as previously discussed, the deceleration also causes the firing pin (4) to impart a shear force to the safety pin shaft (6), thereby delaying its exit from the bore (6A).

At the same time, the fins (8), which previously have been in sliding contact with the internal wall of the barrel, are freed from constraint and expand radially outwardly. In one form of the invention the fins extend in a plane parallel to the axis of the projectile, in which case the fins act merely to stabilize the projectile during its flight. In the preferred form of the invention, however, one plane of the fins is slightly angled to the axis of the projectile itself so that extension of the fins increases the drag and deceleration of the projectile and causes the projectile to spin in a stabilized fashion. At the end of its flight, the dome of the warhead will contact the target area thereby causing the firing pin to contact the initiator (14), which in turn initiates the explosion. It will be appreciated that there is a small delay between the contact of the domed portion of the warhead with the target area and the explosion being initiated. This delay allows the projectile to penetrate, in so far as it can, the target material, thereby increasing the effectiveness of the explosion then generated.

Figure 2:
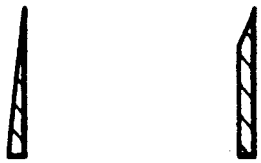
FIG. 2 is a transverse cross-section through the fins of the projectiles shown in FIGS. 1 and 3.

FIG. 2 shows a transverse cross section through an arcuate fin in accordance with the present invention showing the angles of attack of two portions thereof.

Figure 3:
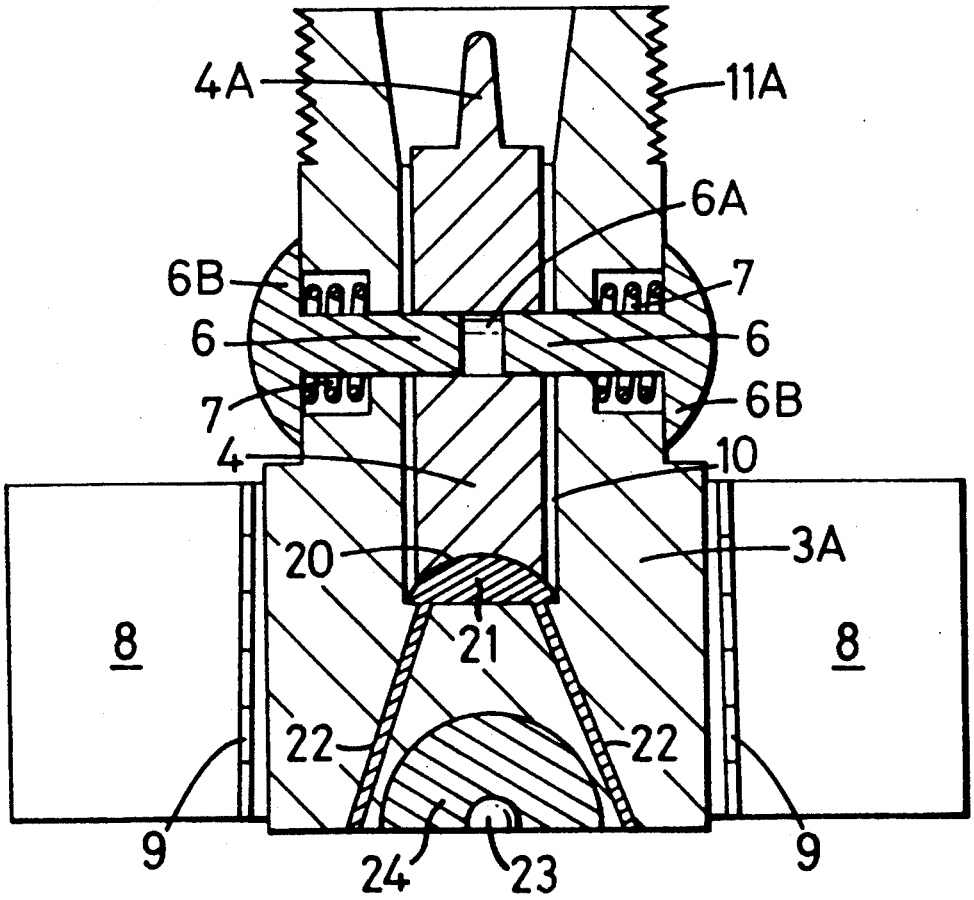

In FIG. 3 a casing of the general form shown in FIG. 1 is shown. The casing of FIG. 3 is adapted to co-operate with a warhead (2) shown in FIG. 1, with the exception that the inter-locking means (12) is replaced by a screw thread means for co-operation with screw thread means (11A) in FIG. 3. With reference to FIG. 3 like parts to those described in FIG. 1 are given similar numbers and are the same unless specifically referred to.

Casing (3A) is of the basic form as shown in FIG. 1, but is provided towards its upper end with a screw thread portion (11A) for inter-connection with the warhead (2). The bore (6A) in the firing pin (4) accommodates a pair of co-axial safety pin shafts (6), each terminating in a safety pin cap (6B). The safety pin shafts (6) are spring biased by means of spring (7) in opposite directions so as to balance the casing upon exiting from the barrel of a weapon.

If desired, a friction collar can be interposed between the two shafts (6) so as to delay by a short period the time it takes to expel the shaft (6) so as to release the firing pin (4). This arrangement can form an arming time delay mechanism as hereinbefore set forth.

Alternatively, or additionally, the firing pin (4) of FIG. 3 can be formed with an arcuate base (20) overlaying an adhesive layer (21) which extends through equally spaced bores (22) to the rear of the casing (3A). The adhesive is combustible and hence will release the firing pin (4) after a predetermined time delay. The firing of the propellant charge will, in turn, commence the combustion of the adhesive material (21) which accordingly will retain the firing pin for a period of up to one second, and more preferably 0.01 to 0.3 seconds. The arming time delay allows the projectile to cover a safe distance before being armed, thereby protecting the operator.

The casing (3A) also bears a tracer compound (24) disposed centrally of the rear of the casing (3A), said tracer compound being actuated by a tracer initiator (23).

The operation of the arrangement of FIG. 3 is in precise accord with that of FIG. 1, except that the arming time delay mechanism provides a further guarantee of safety for the operator and provides a tracer facility.

Figure 4:
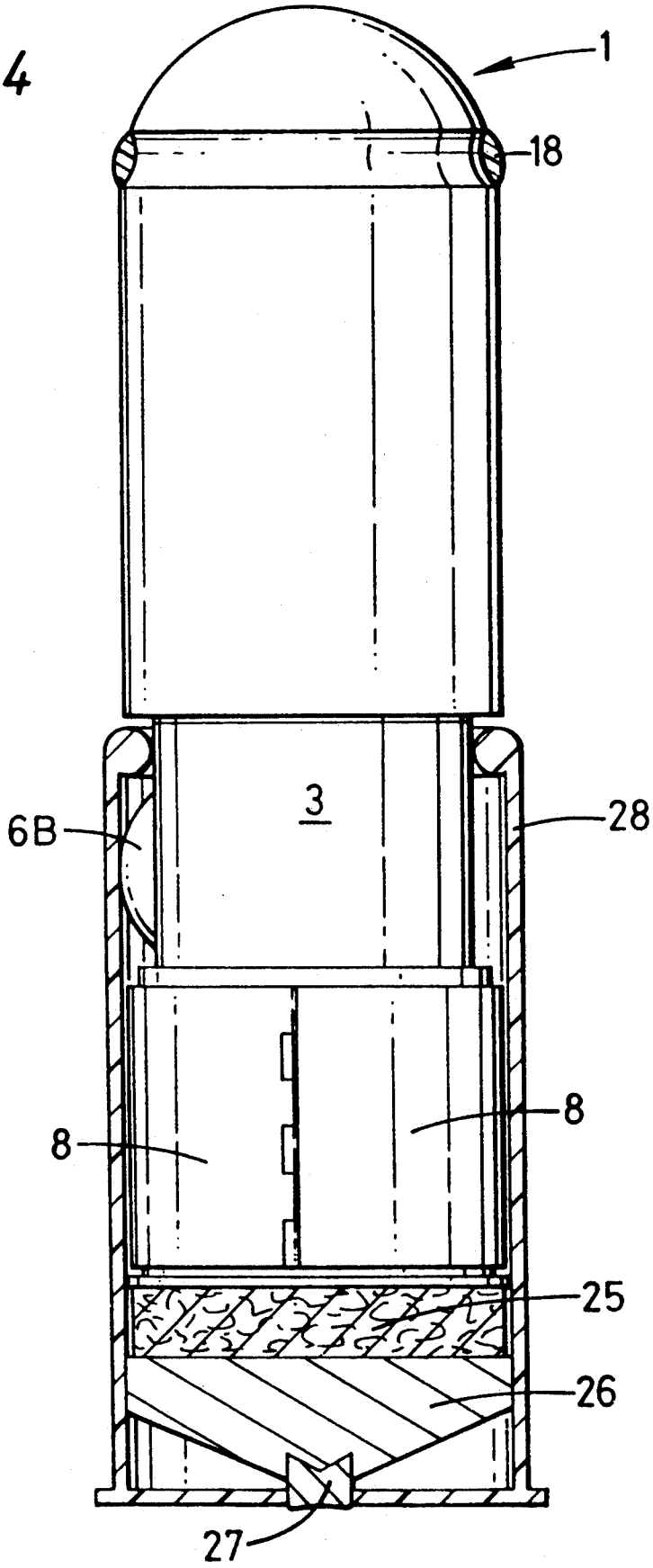
FIGS. 4 and 5 show elevation views, partly in cross-section, of two embodiments of the projectile of the current invention assembled into a cartridge case.

With reference to FIG. 4, there is shown a projectile of FIG. 1 in plan side elevation disposed in a cartridge case which covers only a portion of the projectile, the case being shown in vertical cross-section. Since the features of the missile of FIG. 1 have already been described in detail no further discussion of these will occur. The following description relates only to the new features. The cartridge case (28) is of the type generally sold for use in 12 bore shotguns. It comprises the usual brass head and, in this case, a shell 28 of a plastic material. The brass head is pierced at its center by an aperture which accommodates a percussion cap (27) in the usual way. An amount of a propellent (26) is superposed upon the percussion cap (27) which propellent (26) is in turn overlaid by a standard wadding (25).

It will be noted that in this particular instance the cartridge case (28) covers only a portion of the length of the projectile (1). Although shorter projectiles maybe accommodated wholly within a cartridge case, in this particular instance, the warhead of the missile extends from the cartridge case. The cartridge case (28) overlies the head of the safety pin (6B) and retains the fins (8) in their folded down condition on the casing (3). It will be appreciated that since the casing (3) is in screw threaded inter-engagement with the warhead, the warhead may be disengaged at will from the casing (3), leaving the casing (3) inter-engaged with the cartridge case (28). This allows the warhead to be interengaged with the casing (3) immediately before use and thereby allows different warheads to be selected by those skilled in the art prior to use. It will also be appreciated that the cartridge case (28) may be extended over a portion of the length of the warhead without detracting from the inter-changeability of the warhead assembly.

Figure 5:
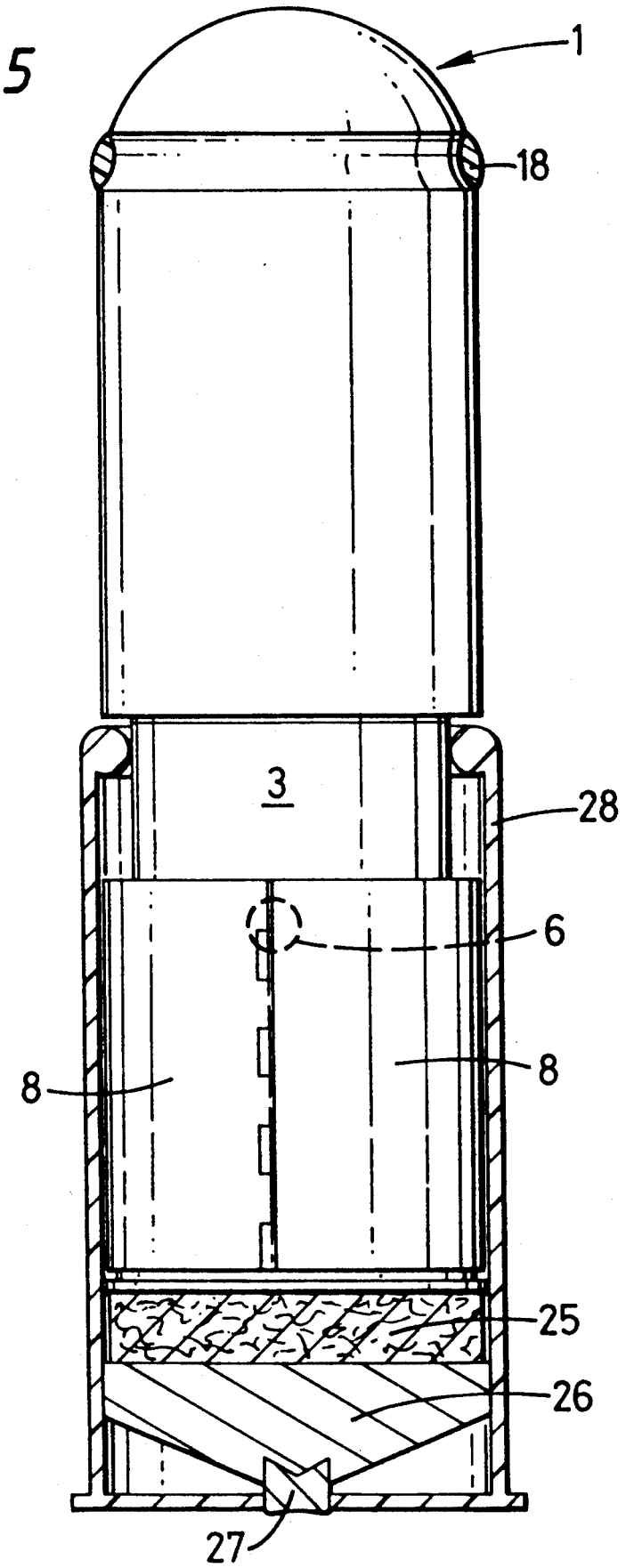

Turning now to the arrangement of FIG. 5, it will be noted that this is identical to FIG. 4 with the exception that the fins (8) have been extended forwardly to cover the shaft of the safety pin (6). It will be appreciated that the head (6B) can then be dispensed with and the safety pin held in its desired position by the underside of one or more of the fins (8).

The invention also relates to a method for the safe manufacture of a projectile in accordance with the present invention wherein the warhead and the casing are separately provided and manufactured, being interlocked only in the final manufacturing stage.

Various changes to the basic structure of the projectile in accordance to the present invention can be made by those skilled in the art without detracting from the spirit and scope of the claims hereinafter set forth. Such changes are not intended to fall outside of the ambit of the invention.

What is claimed:

1. An explosive device, including a projectile to be fired from a shotgun, said projectile comprising:
   a) a warhead having an explosive charge;
   b) a casing having means for joining said casing to said warhead;
   c) a plurality of fins affixed to the periphery of said casing and having means for assuming radially retracted and radially extended positions, whereby said fins cause deceleration of said projectile when said fins assume said extended position;
   d) a firing pin disposed in an approximately axially extending passage in said casing, whereby the momentum of said firing pin upon deceleration of said casing urges said firing pin in the axial direction;
   e) a safety pin having means for engaging said firing pin, thereby locking said firing pin in a safe position, said safety pin disposed in a first approximately radially oriented hole formed in said casing, whereby said firing pin applies a shear force to said safety pin upon said deceleration of said projectile when said fins assume said extended position; and
   f) means for exerting a radial force for disengaging said safety pin from said firing pin, whereby said shear force applied by said firing pin restrains said safety pin against said radial force for a predetermined period of time after said projectile leaves a barrel of a shotgun.

2. The explosive device according to claim 1, wherein said firing pin has a second approximately radially oriented hole formed therein, and wherein said means for engaging said firing pin comprises said safety pin slidably extending through said first hole into said second hole, whereby said deceleration of said projectile causes the sides of said second hole to bear against a portion of said safety pin, thereby retarding sliding of said safety pin in said first and second holes.

3. The explosive device according to claim 1, wherein said predetermined period of time is in the range of 0.01 to 0.3 seconds.

4. The explosive device according to claim 1, further comprising a cartridge case for said projectile, said cartridge case at least partially enclosing said casing and containing a propellent charge for propelling said projectile through a barrel of a shotgun, and wherein said projectile has no other means for propulsion, whereby exiting said barrel causes deceleration of said projectile.

5. The explosive device according to claim 1, wherein said fins are spring biased to assume their radially extended position upon exiting a barrel of a shotgun.

6. An explosive device, comprising a projectile to be fired from a weapon having a smooth bore barrel and a cartridge case at least partially enclosing said projectile prior to firing, said projectile having:
   a) a warhead having an explosive charge;
   b) a casing having means for joining said casing to said warhead;
   c) a firing pin disposed in said casing, whereby forward motion of said projectile imparts forward acting inertia to said firing pin;
   d) a safety pin for locking said firing pin in a safe position, said safety pin being approximately radially oriented in said casing and slidably engaging said firing pin, whereby deceleration of said projectile caused said inertia of said firing pin to impose a force on said safety pin;
   e) means for exerting a radial force propelling said safety pin radially outward, thereby disengaging said safety pin from said firing pin;
   f) restraining means for restraining said safety pin against said radial force prior to firing said projectile; and
   g) a plurality of fins affixed to said casing and having means for assuming radially retracted and radially extended positions for restraining said safety pin against said radial force for a predetermined period of time after said projectile leaves a weapon barrel, said fins having means for causing sufficient deceleration of said projectile when assuming said extended positions so that said force imposed by said firing pin on said safety pin is sufficiently great to restrain said safety pin against said radial force for said predetermined period of time.

7. The explosive device according to claim 6, wherein said restraining means comprises said cartridge case enclosing said safety pin.

8. The explosive device according to claim 6, wherein:
   a) said casing and said firing pin have first and second radially oriented holes formed therein, respectively; and
   b) said safety pin slidably extends through said first hole into said second hole, whereby said deceleration of said projectile causes the sides of said second hole to bear against a portion of said safety pin, thereby retarding sliding of said safety pin in said first and second holes.

9. The explosive device according to claim 6, wherein each of said fins has a surface extending in a plane, each of said planes being oriented at a predetermined angle to the longitudinal axis of said projectile, thereby inducing deceleration of said projectile on meeting still air.

10. The explosive device according to claim 9, wherein said predetermined angle is in the range of approximately 8° to 25°.

11. The explosive device according to claim 9, wherein said predetermined period of time is in the range of 0.01 to 0.3 seconds.

12. The explosive device according to claim 6, wherein said cartridge case contains a propellent charge for propelling said projectile from a weapon barrel, and wherein said projectile has no other means for propulsion, whereby exiting said barrel causes deceleration of said projectile.

13. An explosive device comprising:

a) a cartridge case including a propellant charge, and b) a shotgun projectile for use in a shotgun having a barrel and a chamber, said projectile having a generally cylindrical casing and warhead assembly, said warhead being hollow to accommodate an explosive charge and an initiator, said casing having: (i) a firing pin spring biased to a safety position, (ii) a safety pin extending approximately radially through said casing and engaging said firing pin, thereby locking said firing pin in said safety position, (iii) means for biasing said safety pin radially outward, and (iv) a plurality of fins pivoted to the periphery of said casing so as to be capable of assuming both a folded-down upon said casing position and a radially outwardly deployed position, wherein said projectile is at least in part retained prior to firing in said cartridge case, whereby said cartridge case retains said fins in said folded-down condition, whereby said safety pin radially disengages from said firing pin under the urging of said biasing means and said fins deploy radially outwardly subsequent to said projectile exiting from a shotgun barrel, whereby said deployment of said fins causes deceleration of said projectile sufficient to cause said firing pin to impose a shear force on said safety pin that delays said disengagement of said safety pin from said firing pin for a predetermined period of time after said projectile leaves said barrel.

14. The explosive device according to claim 13, wherein said safety pin comprises a shaft sliding in a bore in said firing pin.

* * * * *